US005542767A

United States Patent [19]

Hedaya et al.

[11] Patent Number: 5,542,767

[45] Date of Patent: Aug. 6, 1996

[54] BAG STUFFER

[75] Inventors: Maurice Hedaya; Ezra Hedaya, both of Brooklyn, N.Y.

[73] Assignee: Barclay Brown, Brooklyn, N.Y.

[21] Appl. No.: 248,503

[22] Filed: May 24, 1994

[51] Int. Cl.[6] ..... B65D 30/00

[52] U.S. Cl. ..... 383/127

[58] Field of Search ..... 383/127; 229/123.2, 229/125.38, 125.39; 206/83.5, 442

[56] References Cited

U.S. PATENT DOCUMENTS

| | | | |
|---|---|---|---|
| 2,126,203 | 8/1938 | Miskella . | |
| 2,774,531 | 12/1956 | Rosenthal . | |
| 2,795,259 | 6/1957 | Nash . | |
| 2,873,905 | 2/1959 | Denton . | |
| 2,998,880 | 9/1961 | Ladd . | |
| 3,589,595 | 6/1971 | White . | |
| 4,033,013 | 7/1977 | Peterson . | |
| 4,050,468 | 9/1977 | Wynnyk . | |
| 4,077,451 | 3/1978 | Zoland . | |
| 4,141,399 | 2/1979 | Zoland . | |
| 4,142,564 | 3/1979 | Zoland | 383/127 |
| 4,483,438 | 11/1984 | Kobiella | 206/83.5 |
| 4,946,292 | 8/1990 | Diamond et al. | 383/127 |
| 4,993,846 | 2/1991 | Diamond et al. | 383/127 |
| 4,998,620 | 3/1991 | Taylor | 206/442 X |
| 5,184,896 | 2/1993 | Hammond et al. . | |
| 5,259,674 | 11/1993 | Hedaya et al. | 383/127 |
| 5,292,197 | 3/1994 | Reisman | 383/127 |
| 5,322,362 | 6/1994 | Smith | 383/127 |

*Primary Examiner*—Jes F. Pascua
*Attorney, Agent, or Firm*—Amster, Rothstein & Ebenstein

[57] ABSTRACT

A bag stuffer for an expandable bag includes an insert defining a pair of substantially planar elements movable from a collapsed orientation enabling compact storage of the expandable bag to an expanded orientation providing a commercial display thereof. The insert is biased to the expanded orientation but a releasable restraint, disposed about the insert and at least partially within the expandable bag, restrains movement of the insert from the collapsed orientation to the expanded orientation. The restraint is preferably a loop of a flexible strip formed by heat sealing one end of the strip to a strip portion adjacent the other end of the strip at at least one point to define a rupturable heat-seal bond. The insert is preferably biased to the expanded orientation by a coil spring having a pair of opposed ends and at least one coil therebetween, each end of the spring passing through a respective one of the planar elements with at least a substantial portion of one coil disposed outwardly of the respective planar element for movement therewith. The insert preferably includes first, second and third substantially planar elements disposed in series parallel to one another, and is biased by a first biasing element substantially disposed intermediate the first and second planar elements and acting to separate the same and a second biasing element substantially disposed intermediate the second and third planar elements and acting to separate the same.

13 Claims, 7 Drawing Sheets

FIG. 6
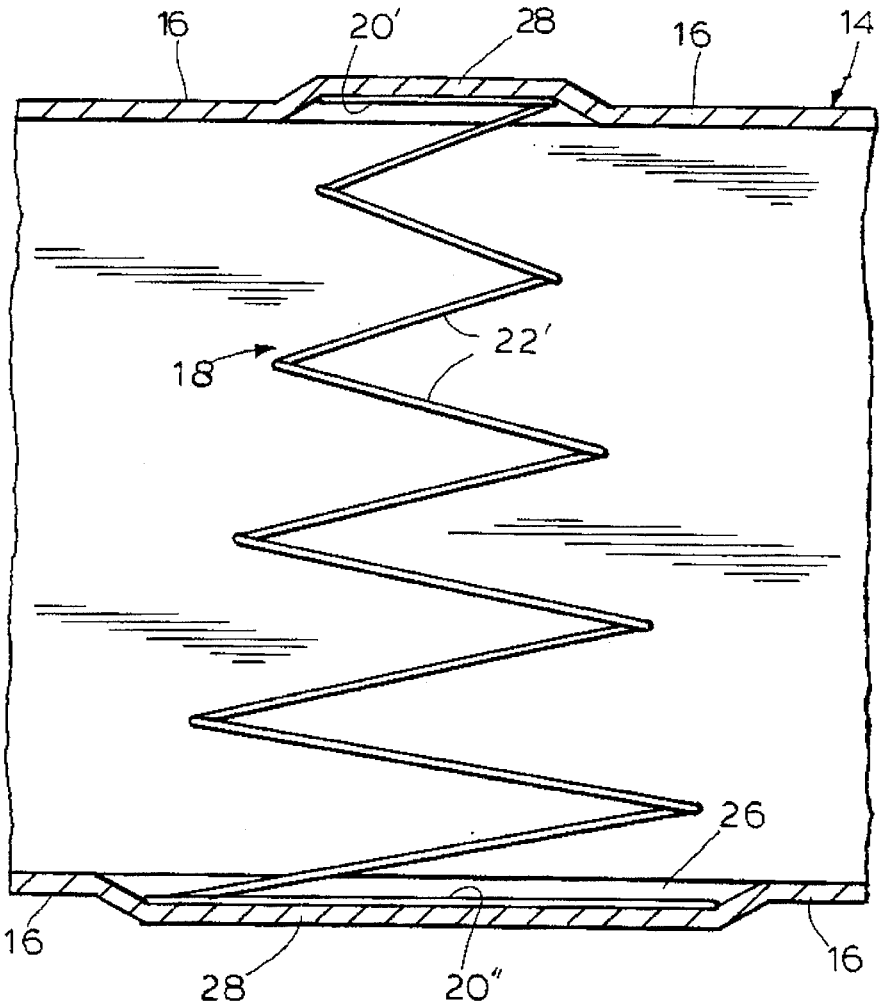
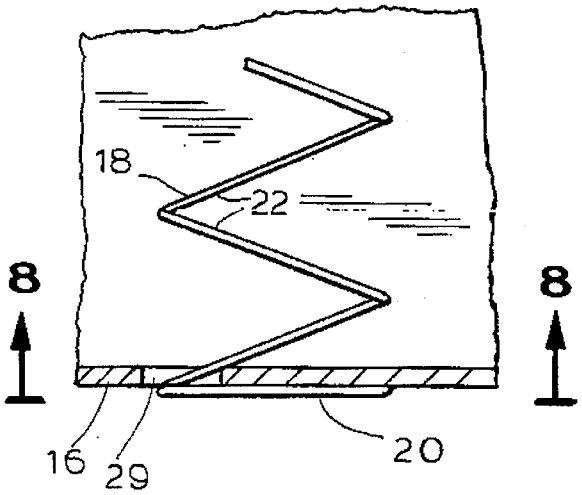
FIG. 7
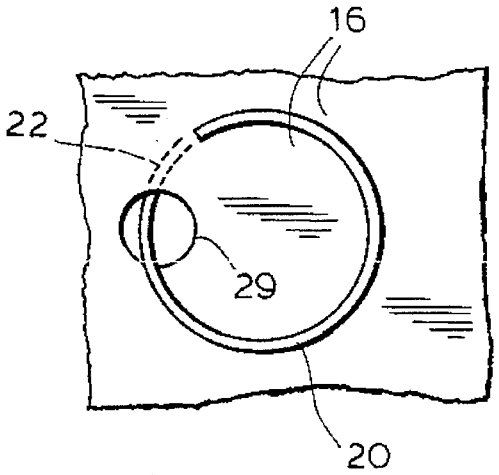
FIG. 8

FIG. 9
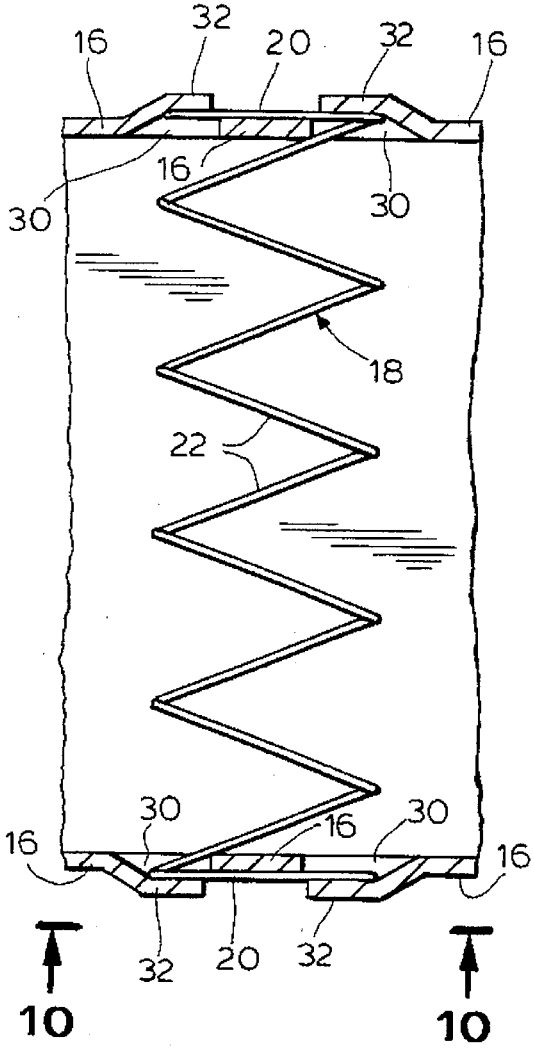
FIG. 11
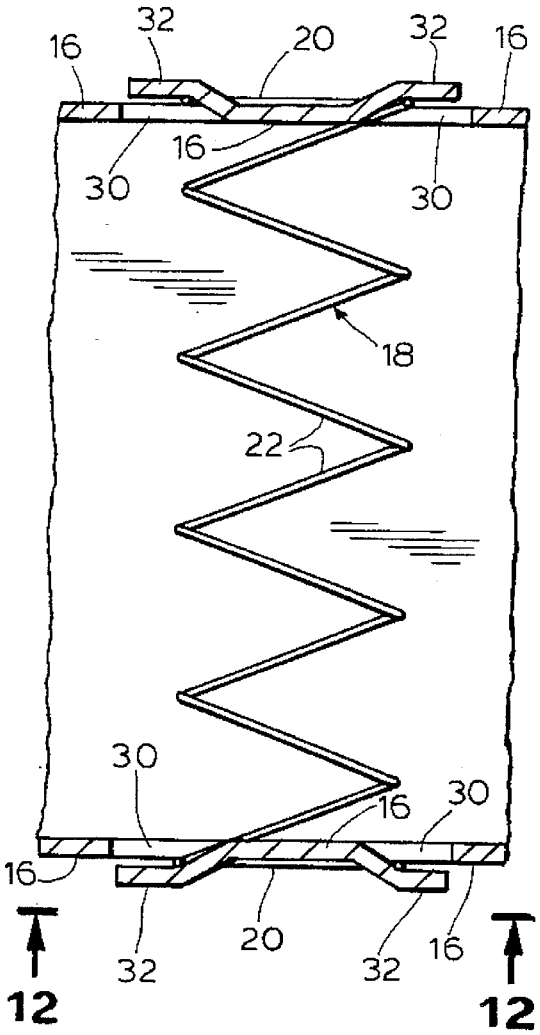
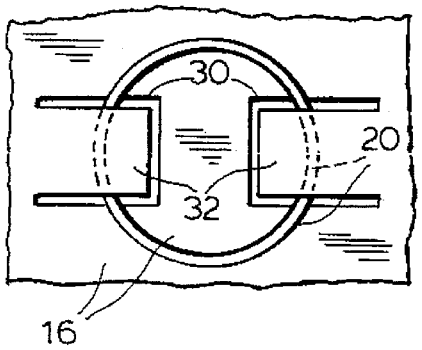
FIG. 10
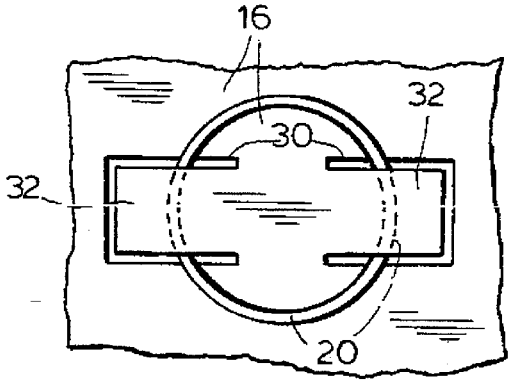
FIG. 12

FIG. 13
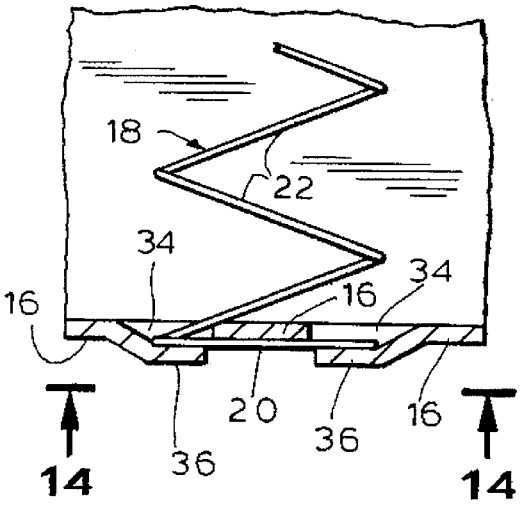
FIG. 15
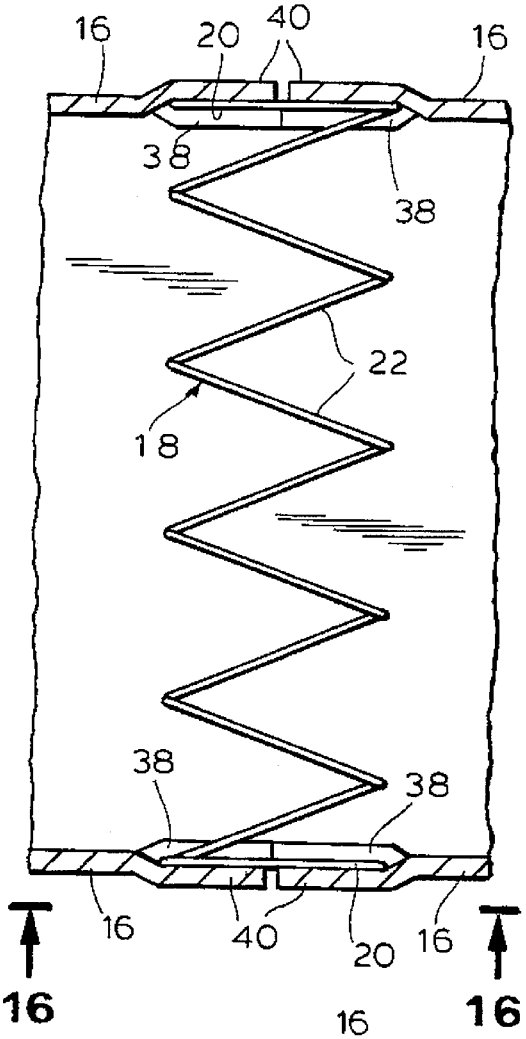
FIG. 14
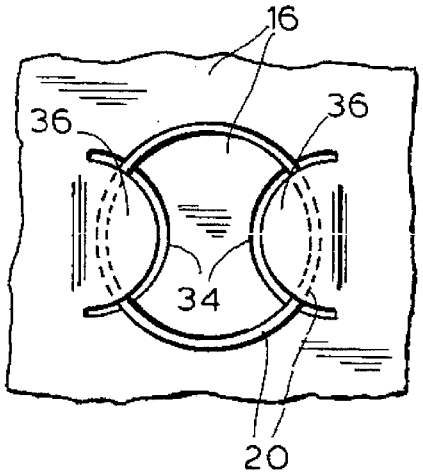
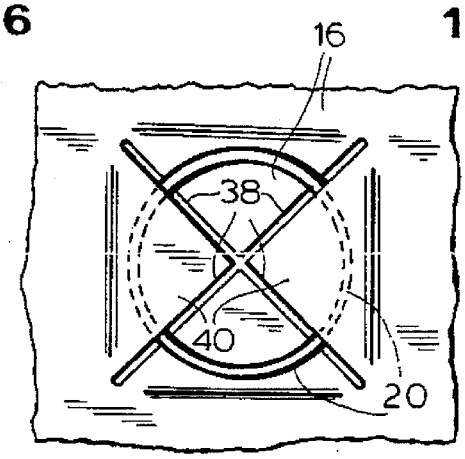
FIG. 16

FIG. 17
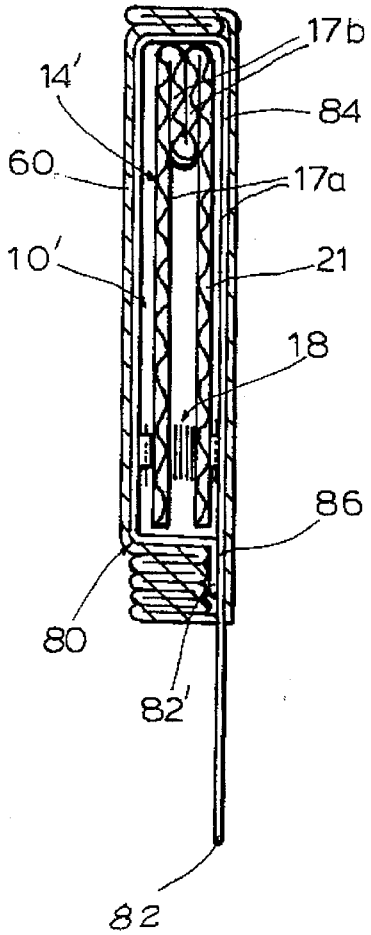
FIG. 18
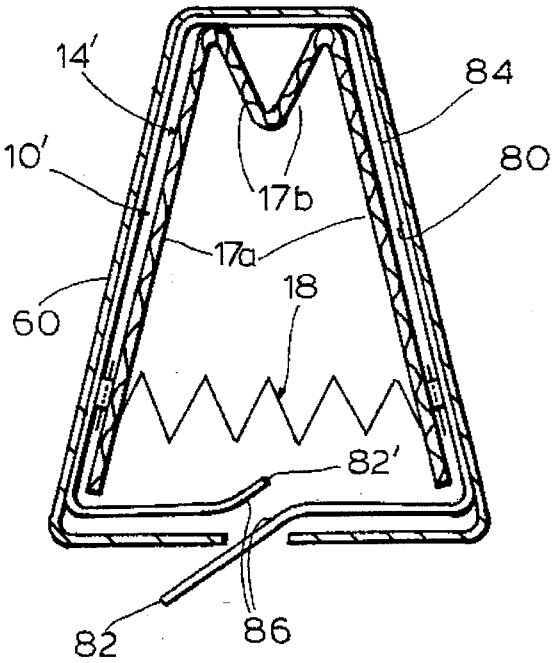
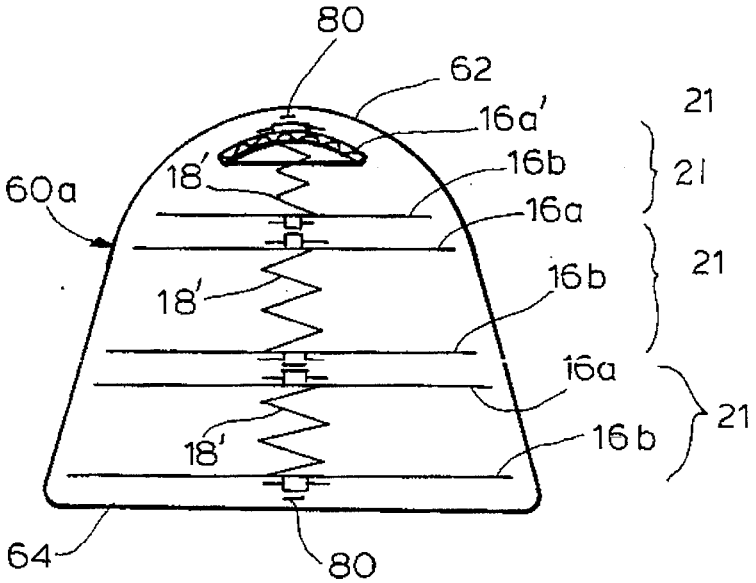
FIG. 19

BAG STUFFER

BACKGROUND OF THE INVENTION

The present invention relates to a bag stuffer having an insert movable from a collapsed orientation, which enables compact storage of an expandable bag containing the insert, to an expanded orientation, which provides a commercial display of the expandable bag containing the insert.

Bag stuffers or expanders are well-known in the retail art. Each bag stuffer includes an insert which is movable from a collapsed orientation, which enables compact storage of an expandable bag containing the insert for shipping and retail storage purposes, to an expanded orientation, which provides a commercial display of an expandable bag containing the insert. Bag stuffers are used with a wide variety of expandable articles which, for reasons of economy, are preferably shipped and stored in a relatively flat or collapsed orientation, but are best presented in commercial displays in an expanded orientation. Such articles include soft-sided luggage, purses, cosmetic kits, Dop kits, briefcases, and the like.

Initially the function of the bag stuffer was performed by cardboard forms or crushed paper which had to be inserted by the retailer after receipt of the collapsed article from the manufacturer. Indeed, some bag stuffers still require the retailer to insert his hand or an instrument into the collapsed article to activate the bag stuffer—that is, to move the insert from its collapsed orientation to its expanded orientation. However the modern bag stuffers typically include means for biasing the insert to the expanded orientation, and releasable restraining means which are disposed about the insert in the collapsed orientation for restraining movement of the insert from the collapsed orientation to the expanded orientation.

In its simplest form, the restraining means may be disposed about the outside of the expandable bag containing the insert so that the retailer has only to cut or otherwise disable the restraining means in order to activate the insert. This is generally not an acceptable situation as the restraining means (or the article used to cut or disable the restraining means) may mar the exterior surface of the bag, thereby rendering it unsaleable. Accordingly, most modern restraining means are disposed about the insert and within the expandable bag containing the insert, so that the restraining means cannot mar the exterior surface of the bag. Typically an end portion of the restraining means extends outwardly from the bag so that, when the extending end portion is pulled, the restraining means is cut, torn or otherwise disabled, thereby permitting the biasing means to activate the insert. For example, the restraining means may be a strap disposed in a loop configuration with the ends of the strap forming a latching mechanism, the latching pin being disengageable from the latching mechanism by means of a string extending outwardly from the latching mechanism and at least partially outside of the expandable bag. Such a latching mechanism is not entirely satisfactory, both because of its high relative cost and because the rigid nature of the latching mechanism and the latching pin introduce the possibility of marring of the interior surface of the bag.

U.S. Pat. No. 5,259,674 discloses a bag stuffer which is relatively inexpensive and safe relative to the stuffer with a latching mechanism. The restraining means consists of a tearable strip disposed about the insert—e.g., a paper loop—and tearing means actuatable from outside of the bag for tearing the strip—e.g., a piece of string. While the patented bag stuffer is an improvement over the bag stuffer with a latching mechanism, it too is not entirely satisfactory. The resistance of the tearable restraining means to being torn determines the strength that is required in order to deploy the tearing means and thereby to actuate the insert. Thus, in order to vary the strength of the pull which is required to actuate the insert, a different paper or tape must be employed as the tearable restraining means. Additionally, the requirement of both tearable means and tearing means (that is, the paper strip wound about the insert and the string positioned to tear the paper strip) renders the manufacture and assembly of the bag stuffer compound and time consuming. Accordingly, the need remains for a bag stuffer which is simple and inexpensive to manufacture and deploy, safe to use, and easily modifiable to vary the strength required to rupture or deactivate the restraining means and thereby to actuate the insert.

A further disadvantage of the known bag stuffers is the requirement that the ends of the biasing means (which is typically a coil spring) must be secured to the planar elements or panels of the insert against which they bear by adhesive or the like. The use of adhesive is typically messy and time consuming (as the adhesive must be given an opportunity to dry before it is subjected to forces which may result in relative movement of the spring and the panel), and therefore expensive. While non-adhesive techniques exist for securing the spring ends and planar elements of the insert together, these typically involve expensive and/or compound mechanisms. Accordingly, the need remains for a bag stuffer wherein the ends of the biasing means are directly secured to the planar elements without adhesives and without expensive and/or compound mechanisms.

A further disadvantage of the known bag stuffers is the limitations on the configurations of the expandable bags with which they are useful. Thus while the known bag stuffers are typically useful with relatively shallow, generally rectangular bags, the various planar elements of the insert which abut the bag and are used to force the bag to its expanded orientation could not be used in connection with cylindrical or duffel-type bags or other bags not having parallel sides. Additionally, even where the bag has parallel sides, the biasing means typically cannot separate the planar elements by more than a given distance (determined by the length of the coil spring biasing means) unless an intermediate panel or flap is used (with the biasing means acting on the flap which in turn separates the planar elements). Accordingly, the need remains for a bag stuffer which can expand unusually shaped bags and which, without the presence of intermediate elements (such as flaps), permits the biasing means to move the planar elements abutting the bag to a desired separation greater than the length of the biasing means.

Accordingly, it is an object of the present invention to provide a bag stuffer which, in a preferred embodiment, is safe to use, simple and inexpensive to manufacture and deploy, and easily modifiable to vary the strength required to rupture or deactivate the restraining means and thereby to actuate the insert.

Another object is to provide a bag stuffer wherein, in a preferred embodiment, the ends of the biasing means are directly secured to the insert planar elements without adhesives and without expensive and/or compound mechanisms.

A further object is to provide a bag stuffer which, in one embodiment, permits the biasing means to move the planar elements abutting the bag to a desired separation greater than the length of the biasing means without the presence of intermediate elements such as flaps.

It is also an object of the present invention to provide a bag stuffer which, in one embodiment, is useful with non-rectangular bags.

SUMMARY OF THE INVENTION

It has now been found that the above and related objects of the present invention are obtained in a bag stuffer for an expandable bag. The bag stuffer comprises: insert means, biasing means and restraining means. In its conventional aspects, the insert means is movable from a collapsed orientation for enabling compact storage of an expandable bag containing the insert means to an expanded orientation for providing a commercial display of an expandable bag containing the insert means. In their conventional aspects, the biasing means is for biasing the insert means to the expanded orientation, and the releasable restraining means, disposed about the insert means and at least partially within an expandable bag containing the insert means, is for restraining movement of the insert means from the collapsed orientation to the expanded orientation. According to a first embodiment of the present invention, the restraining means comprises a loop of a flexible strip formed by heat sealing one end of the strip to a strip portion adjacent the other end of the strip at at least one point to define a rupturable heat-seal bond.

In a preferred first embodiment, the restraining means defines a plurality of the heat-seal bonds, the number and size and strength of the heat-seal bonds being selected to render the loop strong enough to maintain the insert means in the collapsed orientation against the biasing of the biasing means yet weak enough to enable easy intentional manual rupture thereof. Preferably the restraining means defines a plurality of the heat-seal bonds disposed along an axis extending generally transverse to the length of the strip. The other end of the strip extends externally of an expandable bag containing the insert means, thereby to enable intentional manual rupture of the loop from outside of the expandable bag. The restraining means is preferably polypropylene tape.

According to a second embodiment of the present invention wherein the insert means defines a pair of substantially rigid, substantially planar elements, the biasing means comprises a coil spring having a pair of opposed ends and at least one coil therebetween, preferably a plurality of coils therebetween. Each end of the spring passes through a respective one of the planar elements with at least a substantial portion of one coil disposed outwardly of the respective planar element for movement therewith.

In a preferred second embodiment, each of the planar elements is cut therethrough to define at least one tab means (and preferably two tab means) for engaging a respective end of the biasing means. Preferably each of the planar elements has a pair of parallel cuts therethrough to define strip means for engaging a respective end of the biasing means, the strip means being secured to the planar element at both ends of the strip means. The biasing means is typically a cylindrically- or conically-shaped or helical spring.

According to a third embodiment of the present invention, the insert means includes first, second and third substantially planar elements disposed in series parallel to one another. The biasing means includes a first biasing element substantially disposed intermediate the first and second planar elements and acting to separate the same and a second biasing element substantially disposed intermediate the second and third planar elements and acting to separate the same.

In a preferred third embodiment, at least one of the first and second biasing elements comprises a pair of springs acting in parallel on an adjacent pair of the planar elements. At least one of the planar elements differs in size from the remainder of the planar elements, and preferably each of the planar elements is of a different size. At least one of the biasing means may be spaced laterally from the centers of an associated pair of planar elements.

Either the planar elements are substantially rigid or at least one of the planar elements is deformable along at least one axis under the influence of the biasing means, and preferably along two transverse axes. Either the second planar element is formed of two separate but abutting planar layers, each of the separate but abutting planar layers being secured to a different respective one of the biasing elements, or the second planar element is formed of a one-piece planar layer, the one-piece planar layer being secured to two different biasing elements.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 6 is a fragmentary end sectional view of the insert means and a different biasing means;

FIGS. 7, 9, 11, 13 and 15 are fragmentary end sectional views showing a variety of different techniques for securing together the insert and biasing means;

FIGS. 8, 10, 12, 14 and 16 are bottom plan views taken along the lines 8—8 of FIG. 7, 10—10 of FIG. 9, 12—12 of FIG. 11, 14—14 of FIG. 13, and 16—16 of FIG. 15, respectively;

FIG. 17 is an end sectional view of another embodiment of the bag stuffer in the collapsed orientation within an expandable bag of irregular configuration;

FIG. 18 is an end sectional view of the embodiment of FIG. 17 in the expanded configuration; and FIGS. 19–22 illustrate schematically a variety of different compound bag stuffers (each including a plurality of elemental bag stuffers) in the expanded orientation and the bags expanded thereby.

DETAILED DESCRIPTION OF THE PREFERRED EMBODIMENTS

Figure 1:
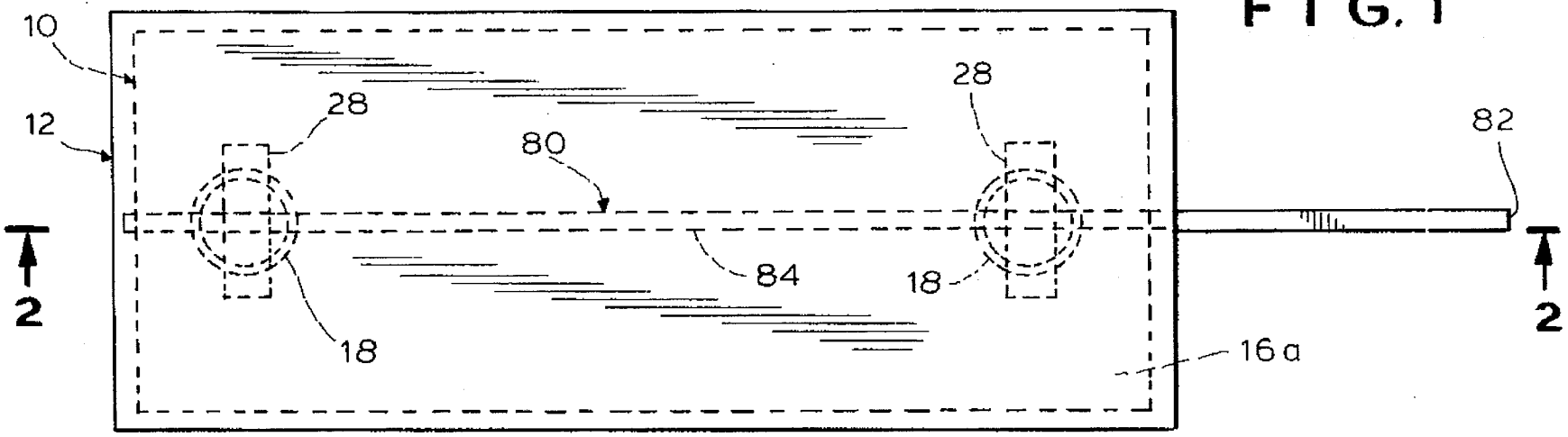
FIG. 1 is a top plan view of a first embodiment of a bag stuffer and expandable bag in the collapsed orientation.
Figure 2:
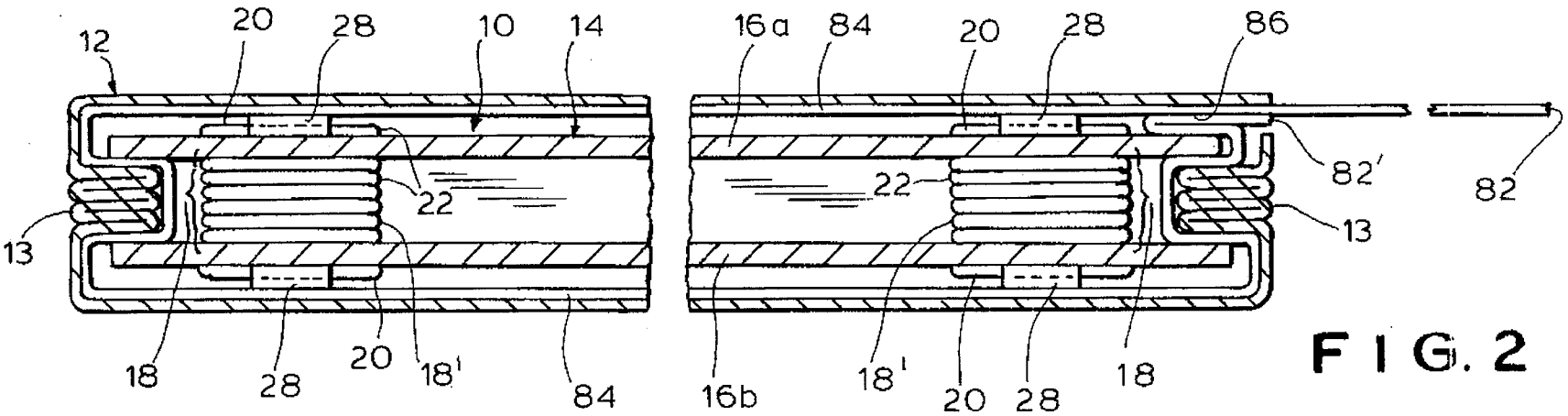
FIG. 2 is a sectional view thereof taken along the line 2—2 of FIG. 1.

Referring now to the drawing, and in particular to FIGS. 1 and 2 thereof, therein illustrated is a first embodiment of a bag stuffer, generally designated by the reference numeral 10, disposed in a collapsed orientation within an expandable bag, generally designated 12. The expandable bag 12 may be soft-sided luggage, a purse, a cosmetic kit, a Dop kit, a briefcase, a backpack or the like and, as illustrated in FIGS. 1 and 2, it is of a generally rectangular right angle parallelepiped or box-like configuration (although, as will be explained in connection with other embodiments of the present invention, the bag may be of circular, trapezoidal, or irregular configurations). It will be appreciated by those familiar with the bag stuffer art that the soft portions of the bag which have been shown in the drawing as folded for illustrative purposes (at 13) are typically randomly crumpled and not folded in the neat and orderly manner as illustrated.

Figure 3:
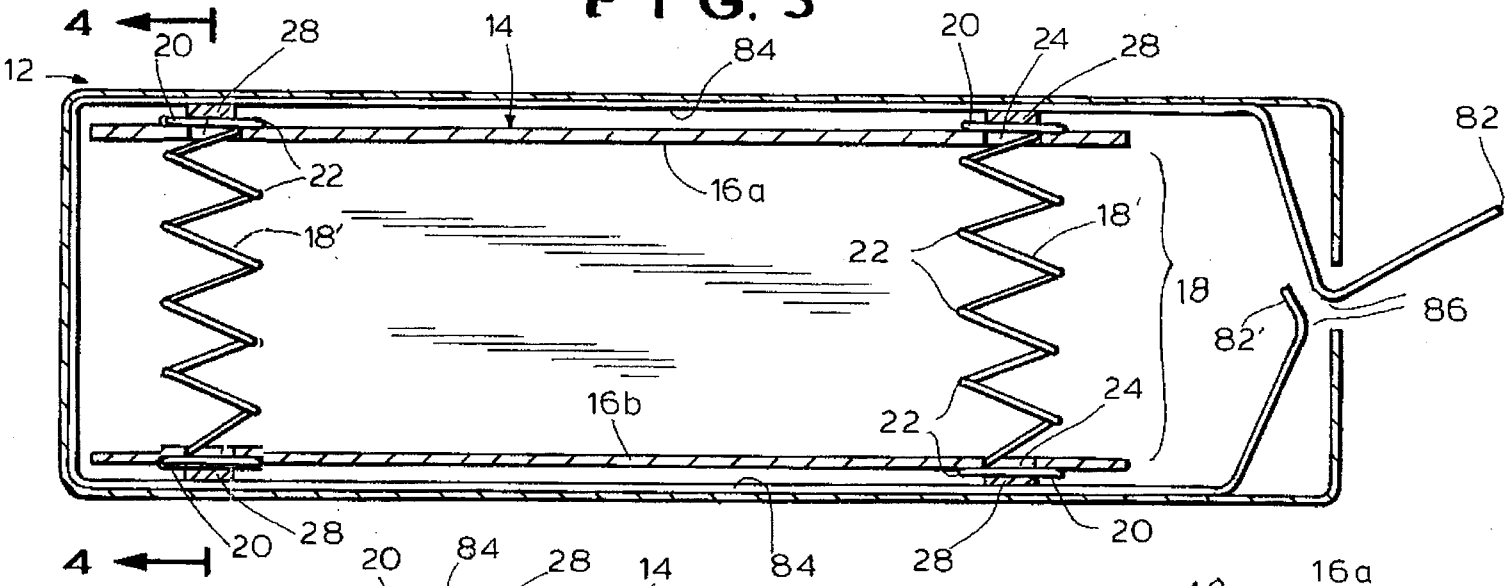
FIG. 3 is a sectional view similar to FIG. 2, but showing the stuffer and bag in the expanded orientation.
Figure 4:
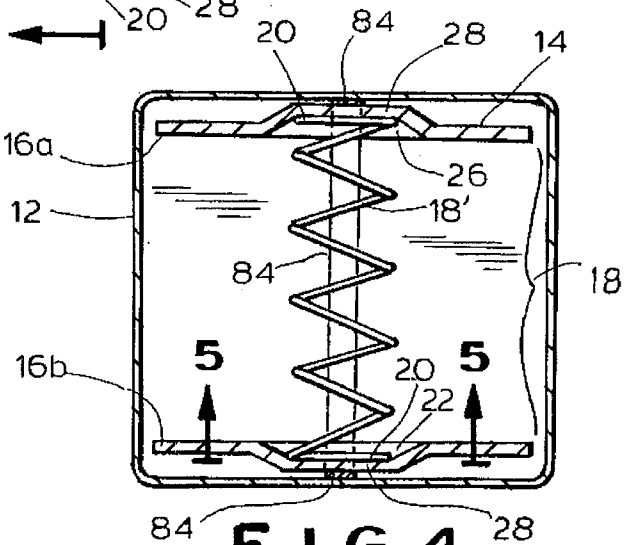
FIG. 4 is an end sectional view thereof taken along the line 4—4 of FIG. 3.

The bag stuffer 10 comprises an insert, generally designated 14, movable from a collapsed orientation enabling compact storage and shipping of the expandable bag 12 containing the insert 14 (as illustrated in FIGS. 1 and 2) to an expanded orientation providing a commercial display of the expandable bag 12 containing the insert 14 (as illustrated in FIGS. 3 and 4). In the illustrated embodiment of the bag stuffer 10, the insert means comprises a parallel pair of substantially planar, substantially rigid elements 16*a*, *16b* which remain parallel in both the collapsed and expanded orientations. The planar elements 16 are preferably formed of paperboard (e.g., cardboard) having edges softer than the interior surface of the bag 12 so that they do not mar the same.

The bag stuffer 10 additionally includes means, generally designated 18, for biasing the insert 14 (and in particular the planar elements 16 thereof) from the collapsed orientation illustrated in FIG. 2 to the expanded orientation illustrated in FIGS. 3 and 4. As illustrated, there are two biasing means 18 provided for the insert 14, one biasing means 18 adjacent each end of the insert means 14 so that the planar elements 16*a*, 16*b* maintain their parallel disposition as they are moved from the collapsed orientation of FIG. 2 to the expanded orientation of FIGS. 3 and 4. Depending on the lengths of the planar elements 16, it may desirable to use a single biasing means 18 (typically connecting the center points of the planar elements 16*a*, 16*b*), two biasing means (as illustrated) or even a greater number of equidistantly spaced apart biasing means 18. Each biasing means 18 defines a biasing element 18' with one of its respective end portions 20 secured to one planar element 16*a* for movement therewith and its other end portion 20 secured to the other planar element 16*b* for movement therewith. The biasing elements 18' and the planar elements 16 connected thereby constitute an elemental insert/biasing means assembly 21.

Preferably, as illustrated in FIGS. 1–5, the biasing means 18 is a coil or helical spring having a pair of opposed ends portions 20 and at least one coil or helix 22 therebetween, and preferably a plurality of coils or helixes 22 therebetween. Each end 20 of the spring 18 passes outwardly through a respective one of the planar elements 16 (and in particular, an opening 24 therethrough) and has at least a substantial portion of one coil 22 disposed outwardly of the main plane of the respective planar element 16 for movement therewith.

A releasable restraining means, generally designated 80, is disposed about the elemental assembly, and at least partially within the expandable bag 12 containing the elemental assembly 21, for restraining movement of the insert 14 from the collapsed orientation to the expanded orientation. The restraining means 80 preferably comprises a flexible strip with ends 82, 82' and a loop 84 formed by heat sealing one end 82 of the strip to a strip portion adjacent the other end 82' of the strip at at least one point 86 thereby to define a rupturable heat-seal bond at that point. Typically, the restraining means 80 defines a plurality of the heat-seal bonds 86, the number, size and strength of the heat-seal bonds 86 being selected to render the loop 84 strong enough to maintain the insert 14 in the collapsed orientation against the biasing of the biasing means 18, yet weak enough to enable easy intentional manual rupture thereof. Preferably the restraining means 80 defines a plurality of the heat-seal bonds 86 extending generally transverse to the length of the strip. The restraining means loop 84 may extend longitudinally or transversely of the insert 14 as desired for a particular application and insert size.

The strip may be heat-sealable along the entire length thereof and on both surfaces thereof. However, for reasons of economy, the restraining means is optionally made heat-sealable (for example, by application of a coating thereto) only at selected portions along the lengths of one or both surfaces thereof, as necessary to enable the strip to form a loop by heat-sealing. A variety of heat-sealable flexible strips are well-known in the art and any of these offering the proper balance of strength and weakness for the purpose of the present invention may be used herein. A preferred heat-sealable strip is formed from polypropylene tape.

The free end 82 of the restraining means 80 extends externally of the expandable bag 12 containing the insert 14, thereby to enable intentional manual rupture of the loop from outside of the expandable bag 12. There typically exists at least some portion of the interface of the surfaces about the "closed" bag opening which enables passage therethrough of a thin strip without so distorting the strip as to immobilize it. Preferably the free end 82 of the restraining means exits the expandable bag at an angle which facilitates rupture of the heat-seal bonds 86 when the free end 82 is pulled by hand from outside the closed bag 12.

Figure 5:
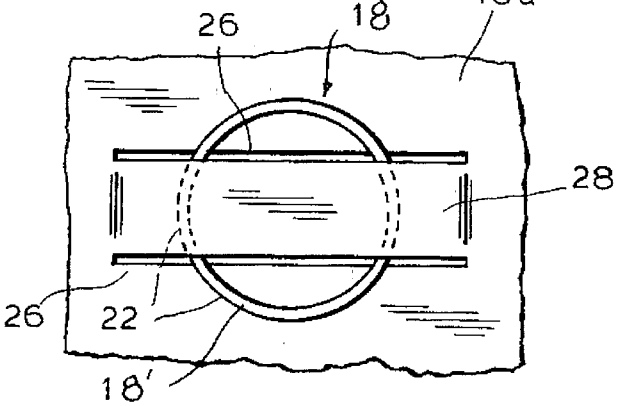
FIG. 5 is a fragmentary top plan view thereof, to a greatly enlarged scale, showing the interconnection between a spring end and an insert planar element.

As illustrated in FIGS. 1–5, and best seen in FIG. 5, each of the planar elements 16 has a pair of parallel cuts 26 therethrough which serve as the openings 24 and define therebetween a tab 28 for engaging a respective end 20 of the spring 18. As each tab 28 is defined by a pair of parallel cuts 26, the tab 28 remains secured to the planar element 16 at both ends and is thus best considered as a "strip" 28. It will be appreciated that the parallel cuts 26 forming strip 28 enable the spring end 20 to be threaded through the planar element 16 from an inner surface thereof to an outer surface thereof by rotation of the spring 18 relative to the planar element 16. In the absence of further relative rotation between the spring 18 and the planar element 16, the planar element 16 (including the strip 28) precludes further inward or outward movement of the spring end 20 relative thereto. Accordingly, this direct connection between the biasing means 18 and insert planar element 16 for movement of the two elements as a unit does not require the use of adhesives or other compound and/or expensive securing means. Other direct means of securing a biasing means end 20 to a respective insert planar element 16, so that each end 20 passes through a respective planar element 16 with at least substantially one coil 22 disposed outwardly of the planar element for movement therewith, are illustrated in FIGS. 7–8, 9–10, 11–12, 13–14 and 15–16.

More particularly, FIGS. 7 and 8 illustrate a very basic and simple securing technique wherein the planar element 16 defines a single cut or aperture 29 therethrough (which aperture 29 need only be of sufficient dimensions to enable passage of the spring end 20 therethrough). The spring 18 and planar element 16 are rotated relative to one another so that substantially at least one coil 22 is disposed outwardly of the planar element 16.

FIGS. 9–12 illustrate each planar element 16 having at least one U-shaped cut 30 defining a U-shaped tab 32 and preferably, as illustrated, two U-shaped cuts 30 defining two U-shaped tabs 32. The tabs 32 are substantially disposed in a plane parallel to and slightly outwardly spaced from the plane of the planar element 16 thereby to accommodate disposition of a spring end 20 in a plane intermediate the two tabs 32 and the remainder of the planar element 16. In FIGS. 9 and 10 the free ends of the tabs 32 extend towards one another (i.e., approach the axis of the spring), whereas in FIGS. 11 and 12 the free ends of the tabs 32 retreat from one another (i.e., extend outwardly from the axis of the spring).

FIGS. 13 and 14 illustrate a securing technique similar to that illustrated in FIGS. 9 and 10 except that there are two semi-circular cuts 34 defining two semi-circular tabs 36 (rather than U-shaped cuts 30 defining U-shaped tabs 32). While not illustrated, clearly the semi-circular cuts 34 and the semi-circular tabs 36 could be disposed as illustrated in FIGS. 11 and 12 (rather than as illustrated in FIGS. 9 and 10). FIGS. 15 and 16 illustrate a securing technique analogous to that illustrated in FIGS. 13 and 14, except that there are two V-shaped cuts 38 defining two V-shaped tabs 40 (rather than semi-circular cuts 34 defining semi-circular tabs 36).

It will be appreciated that FIGS. 9–16 illustrate only some of the multitude of possible tab arrangements useful in the present invention for directly securing together a planar element and a respective end of the biasing means for movement as a unit. Indeed, each of the securing techniques illustrated in FIGS. 1–16 enable the ends of the biasing means to be directly secured to the insert planar elements without adhesives and without expensive and/or compound mechanisms. Once the appropriate cut or cuts have been made in each of the planar elements, the appropriate end of the biasing means and the planar element are easily and rapidly secured together without the use of adhesives or extraneous mechanisms. While the spring end portion 20 extending outwardly of the planar element 16 could theoretically mar the interior surface of the bag against which it abuts, its effect is cushioned by the presence of the tabs 28, 32, 36, 40 which limit the force applied to the interior surface of the bag. As the extreme ends of the springs 18 may contain sharp or rough edges, preferably each extreme end is disposed beneath one of the tabs 28, 32, 36, 40 to preclude any possibility of its scratching the interior surface of the bag.

While the biasing means 18 has been shown and described hereinabove as a cylindrically-shaped coil or helical spring, biasing means of different configurations may be employed instead. Thus, as illustrated in FIG. 6, the biasing means 18 may be a conically-shaped coil or helical spring having a pair of ends 20', 20" connected by coils 22'. One spring end 20' (the top end as illustrated in FIGS. 6) is of lesser diameter than the other spring end 20" (the bottom end as illustrated in FIG. 6). In this instance, the parallel cuts 26 and strip 28 associated with the larger spring end 20" will normally be of correspondingly greater dimensions than the parallel cuts 26 and strip 28 associated with the smaller spring end 20'. The conically-shaped spring 18 facilitates assembly of the elemental assembly 21 by the manufacturer.

The insert 14 has been shown and described hereinabove as having a plurality of planar elements 16 which are substantially rigid and which remain substantially parallel to each other in both the collapsed and expanded configurations and therebetween; however, this is not necessarily the case. Inserts may be constructed in a variety of different ways as required to best display a bag of a particular size and shape in the expanded configuration. For example, referring now to FIGS. 17 and 18, therein illustrated is a bag 60 of generally trapezoidal configuration when in the expanded configuration (as illustrated in FIG. 18). A bag stuffer 10' is disposed at least partially within the expandable bag 60, the bag stuffer 10' comprising an insert biasing means assembly 21 and a restraining means 80 including a pair of ends 82, 82' and a loop 84 form therebetween by means of a heat seal bond 86. The insert 14' is in the configuration of a laterally collapsed "W" when the insert is in the collapsed configuration (as illustrated in FIG. 17) and a full or laterally expanded "W" when the insert is in the expanded configuration (as illustrated in FIG. 18). The biasing means 18 (illustrated as a cylindrical-shaped coil or helical spring) is secured to the major or long outer legs **17*a* of the W-shaped insert adjacent to the free ends thereof. When the heat-seal bonds 86 are ruptured by pulling on the free end 82 of the restraining means 80 (which extends outwardly from the bag 60), the biasing means 18 not only acts to push the free ends of the major legs 17*a* apart, but also, to a lesser degree, to separate the junctures of the major legs and the minor or small inner legs 17*b*, thereby to "fill out" the small side of the trapezoidal bag 60. It will be appreciated that in this instance the major legs 17*a* and minor legs 17*b* of the insert 14' are initially parallel (see FIG. 17) but, as the insert assumes the expanded orientation, neither the long nor the short legs remain parallel to each other (see FIG. 18**).

Referring now to FIGS. 19–22, therein schematically illustrated are expandable bags, each bag being disposed in the expanded configuration and containing a compound assembly formed of a plurality of the elemental insert/biasing means assemblies 21 described hereinabove. The elemental assemblies 21 are disposed in series and parallel to one another. In this manner, the overall separation between the extreme end planar elements 16 (which abut the bag interior) of the compound assembly may be greater than the extent of any one of the biasing means 18 thereof.

Referring now to FIG. 19, therein illustrated is a bag, generally designated 60A, of irregular configuration defining a hemispherical top 62, a flat bottom 64 and a pair of angular sides 66 therebetween. A compound assembly formed of three elemental assemblies 21 is disposed within the bag 60, the various elemental assemblies being disposed parallel to one another in a vertical series. The upper planar element **16*a* of each elemental assembly is smaller than the lower planar element 16*b* thereof, and the lower planar element 16*b* of each elemental assembly is smaller than the upper planar element 16*a* of the elemental assembly therebelow. While the upper planar element 16*a* of the top elemental assembly and the bottom planar element 16*b* of the bottom elemental assembly mainly effect preparation of the top 62 and the bottom 64 of the expandable bag 60, the intermediate planar elements 16 assist in maintaining the angled sides 66 of the bag 12 in the expanded configuration. It will be appreciated by those skilled in the art that a unique feature of the compound assembly illustrated in FIG. 19 is that each of the planar elements 16** thereof differs in size (that is, in length, width or both), thereby illustrating the adaptability of the present invention to stuffing bags of almost any irregular configuration.

While the various elemental assemblies within the bag 60A have been schematically illustrated as having the planar elements 16 thereof secured to the respective ends of the biasing elements 18' by the technique illustrated in FIGS. 1–5, it will appreciated that this is only a preferred securing method and that any of the other securing methods of the present invention, and indeed any of the conventional securing means (e.g, adhesive), may be used.

Figure 20:
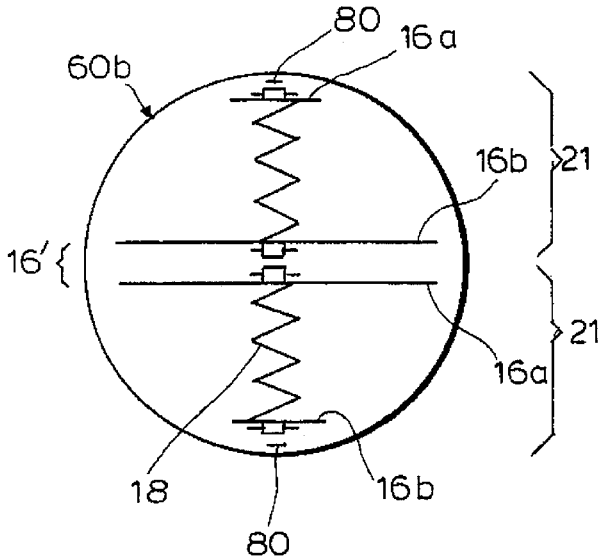
Figure 21:
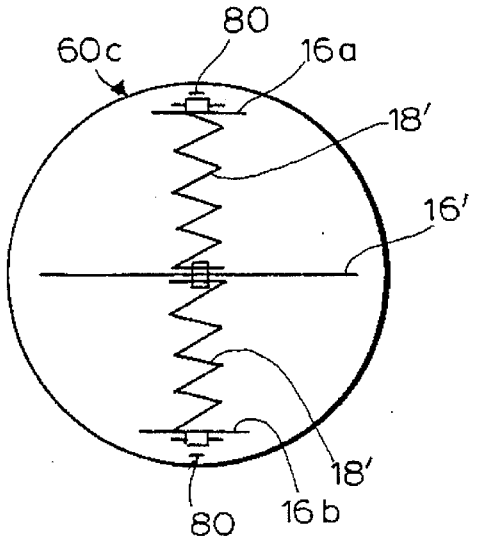
Figure 22:
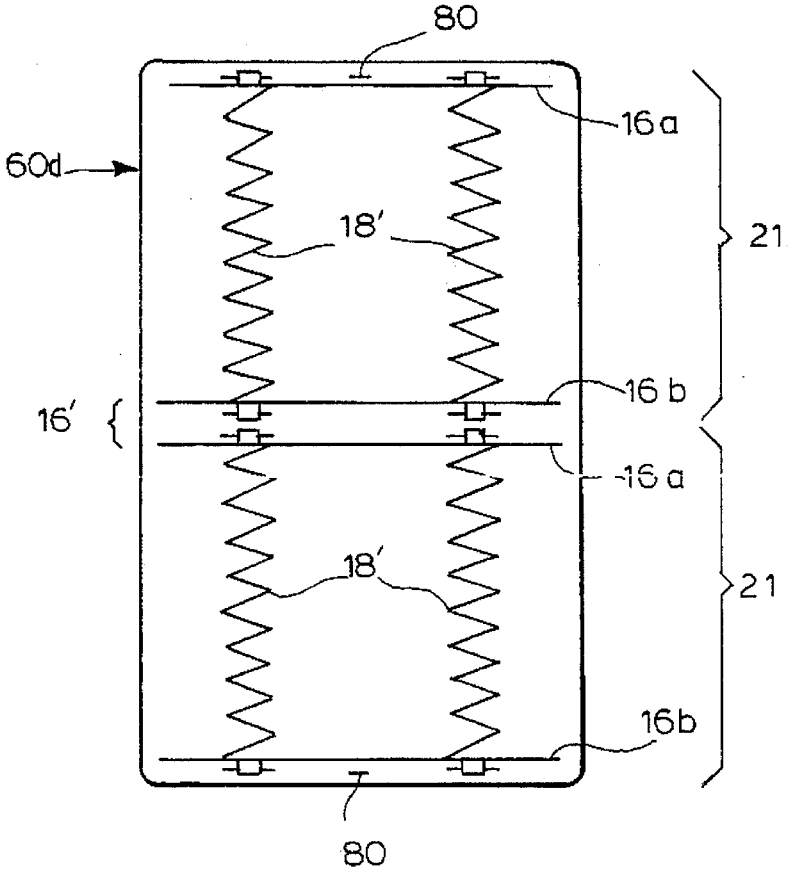

As earlier noted with respect to FIGS. 1–5 and as will be the case with FIGS. 20–22, the planar elements 16 are typically substantially planar at all times and substantially rigid. However, FIG. 19 shows that at least one planar element 16 of at least one elemental assembly 21 (here the top planar element 16*a*' of the top elemental assembly 21) may be flexible along at least a plurality of parallel axes under the influence of the biasing means 18 so that it can deform and thereby fully expand a hemicylindrical top. Preferably, in a suitable case, 20 as illustrated in FIG. 19, the planar element 16*a*' is resistively flexible along a plurality of transverse axes under the influence of the biasing means 18 so that it can conform to and fully expand a hemispherical top 62. The term "resistively flexible" indicates that the planar element (which may be a corrugated board) resists deformation or flexing but will deform or flex along a plurality of predetermined axes under the influence of the biasing means and a bag contour as the biasing means drives the initially planar element against the bag contour.

Referring now to FIG. 20, therein illustrated are an expandable bag 60B having the configuration of a cylinder or duffel bag and a compound assembly formed of a pair of elemental assemblies 21 disposed therein, the elemental assemblies being disposed vertically in series and parallel to each other. The two abutting planar elements—that is, the bottom planar element 16*b* of the top assembly and the upper planar element 16*a* of the lower elemental assembly are the same size, while the two remaining planar elements are also the same size, but smaller. All planar elements are substantially rigid and substantially parallel.

Referring now to FIG. 21, therein illustrated are an expandable bag 60B and a compound assembly formed of a pair of elemental assemblies 21 similar to those illustrated in FIG. 20 except that there is only one large common planar element 16' to which the biasing means 18 of both elemental assemblies are secured. Indeed, the embodiment of the compound assembly illustrated in FIG. 21 may be considered functionally as one single elemental assembly according to the present invention, with the biasing means 18 running continuously between the two small outer planar elements, but with a third larger planar element 16' secured to the middle of the biasing means parallel to the small planar elements. All planar elements are substantially rigid and substantially parallel.

The embodiment of FIG. 21 represents the functional equivalent of the embodiment of FIG. 20. The insert means illustrated therein includes first, second and third elements 16*a*, 16', 16*b* disposed in series parallel to one another. The biasing means 18 includes a first biasing element 18' substantially disposed intermediate the first and the second planar elements 16*a*, 16' and acting to separate the same, and a second biasing element 18' substantially disposed intermediate the second and third planar elements 16', 16*b* and acting to separate the same. In FIG. 20 the second planar element is formed of two separate planar layers 16*a*, 16*b*, each of the separate planar layers thereof being secured to a different respective one of the biasing elements 18', while in FIG. 21 the second planar element is a single layer 16'. Clearly, the separate planar layer 16*a*, 16*b* of FIG. 20 could be secured together (e.g., glued) to form a single layer 16'.

Referring now to FIG. 22, therein illustrated are an expandable bag 60C and a compound assembly formed by a pair of elemental assemblies 21 similar to those illustrated in FIG. 20, except that the expandable bag 60C is generally rectangular in configuration, all planar elements 16 are substantially the same size, and the elemental assemblies 21 each have two biasing elements 18' in parallel. All planar elements are substantially rigid and substantially parallel.

Where a plurality of the elemental assemblies 21 are used in series to form a compound assembly, at least those planar elements 16 intermediate the extreme end elements 16 are preferably substantially rigid and remain substantially parallel. At least one of the biasing elements 18' may be spaced laterally from the centers of an associated pair of planar elements (i.e., the biasing elements 18' need not be in 100% alignment). The abutting planar elements 16 of adjacent elemental assemblies 21 are optionally secured together to facilitate handling of the compound assembly.

A restraining means 80 is disposed about the compound assembly of the plurality of inserts 14 and biasing means 18 in FIGS. 19–22 so as to maintain the entire compound assembly (as well as each of the elemental assemblies 21 forming a portion thereof) in the collapsed orientation until the restraining means 80 is released, thereby to allow the compound assembly (and each of the elemental assemblies 21 forming a portion thereof) to assume the expanded orientation.

It will be appreciated that, while various aspects of the present invention have been shown in combination and in fact are preferably used together in a preferred embodiment, any one aspect of the present invention may be used in combination with conventional elements to also form a bag stuffer according to the present invention. Thus, the heat-sealable restraining means may be used in conjunction with conventional insert and biasing means, the techniques for securing the biasing means and the insert planar elements together may be used in conjunction with conventional restraining means, biasing means and inserts, and the compound assembly formed from a plurality of elemental assemblies may be used in connection with conventional restraining means, biasing means and insert means.

It is contemplated that commercially the bag stuffer according to the present invention will be manufactured separately from the expandable bag with which it is used. The bag stuffer will be manufactured and sold in the closed orientation—that is, with the insert 14 in the collapsed orientation and the restraining means being disposed thereabout to retain the insert 14 in the collapsed orientation against the influence of the biasing means 18. In the case of bag stuffers with compound assemblies formed of a plurality of elemental assemblies, a single restraining means 90 is preferably disposed about the entire compound assembly. The stuffer is sold and delivered as a complete assembly ready for use and not requiring any assembly by the user.

To summarize, the present venture provides a bag stuffer which, in selected preferred embodiments, is safe to use, simple and inexpensive to manufacture and deploy, and easily modifiable to vary the strength required to rupture or deactivate the restraining means and thereby to actuate the insert. The ends of the biasing means are directly secured to the planar elements of the insert without adhesives and without expensive and/or complex mechanisms. The bag stuffer may have a biasing means which moves the planar elements supporting the bag to a desired separation greater than the length of the biasing means without the presence of intermediate elements such as flaps. The stuffer is useful with non-rectangular bags as well as rectangular bags.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. In a bag stuffer for an expandable bag, said bag stuffer comprising:

(A) insert means movable from a collapsed orientation for enabling compact storage of an expandable bag containing said insert means to an expanded orientation for providing a commercial display of an expandable bag containing said insert means;

(B) biasing means for biasing said insert means to said expand orientation; and (C) releasable restraining means, disposed about said insert means and adapted to be disposed at least partially within an expandable bag containing said insert means, for restraining movement of said insert means from said collapsed orientation to said expanded orientation;

the improvement wherein said insert means includes first, second and third substantially rigid, substantially planar elements disposed in series parallel to one another, and said biasing means includes a first biasing element substantially disposed intermediate said first and second planar elements and acting to separate the same and a second biasing element substantially disposed intermediate said second and third planar elements and acting to separate the same; said second planar element being formed of a one-piece planar layer, said one-piece planar layer being directly secured to two different biasing elements.

2. The stuffer of claim 1 wherein at least one of said first and second biasing elements comprises a pair of springs acting in parallel on an adjacent pair of said planar elements.

3. The stuffer of claim 1 wherein at least one of said planar elements differs in size from the remainder of said planar elements.

4. The stuffer of claim 3 wherein each of said planar elements is of a different size.

5. The stuffer of claim 1 wherein each of an associated pair of planar elements define centers thereof, and at least one of said biasing elements is spaced laterally from said centers of an associated pair of planar elements.

6. In a bag stuffer for an expandable bag, said bag stuffer comprising:

(A) insert means movable from a collapsed orientation for enabling compact storage of an expandable bag containing said insert means to an expanded orientation for providing a commercial display of an expandable bag containing said insert means;

(B) biasing means for biasing said insert means to said expanded orientation; and (C) releasable restraining means, disposed about said insert means and adapted to be disposed at least partially within an expandable bag containing said insert means, for restraining movement of said insert means from said collasped orientation to said expanded orientation;

the improvement wherein said insert means includes first, and second and third substantially rigid, substantially planar elements disposed in series parallel to one another, and said biasing means includes a first biasing element substantially disposed intermediate said first and second planar elements and acting to separate the same and a second biasing element substantially disposed intermediate said second and third planar elements and acting to separate the same, said second planar element being formed of two separate and abutting planar layers, each of said separate and abutting planar layers being secured to a different respective one of said biasing elements; at least one of said planar elements being deformable along at least a plurality of parallel axes under the influence of said biasing means.

7. In a bag stuffer for an expandable bag, said bag stuffer comprising:

(A) insert means defining a pair of substantially rigid, substantially planar elements movable from a collapsed orientation enabling compact storage of an expandable bag containing said insert means to an expanded orientation providing a commercial display of an expandable bag containing said insert means;

(B) biasing means for biasing said insert means to said expanded orientation; and (C) releasable restraining means, disposed about said insert means and adapted to be disposed at least partially within an expandable bag containing said insert means, for restraining movement of said insert means from said collapsed orientation to said expanded orientation;

the improvement wherein said biasing means comprises a coil spring having a pair of opposed ends and at least one coil therebetween, each end of said spring passing through a respective one of said planar elements with at least a substantial portion of one coil disposed outwardly of said respective planar element for movement therewith.

8. The stuffer of claim 7 wherein each of said planar elements is cut therethrough to define at least one tab means for engaging a respective end of said biasing means.

9. The stuffer of claim 8 wherein each of said planar elements is cut therethrough to define two opposed tab means for engaging a respective end of said biasing means.

10. The stuffer of claim 7 wherein each of said planar elements has a pair of parallel cuts therethrough to define strip means for engaging a respective end of said biasing means, said strip means being secured to said planar element at both ends of said strip means.

11. The stuffer of claim 7 wherein said biasing means comprises a conically-shaped helical spring.

12. In a bag stuffer for an expandable bag, said bag stuffer comprising:

(A) insert means defining a pair of substantially rigid, substantially planar elements movable from a collapsed orientation enabling compact storage of an expandable bag containing said insert means to an expanded orientation providing a commercial display of an expandable bag containing said insert means;

(B) biasing means for biasing said insert means to said expanded orientation; and (C) releasable restraining means, disposed about said insert means and adapted to be disposed at least partially within an expandable bag containing said insert means, for restraining movement of said insert means from said collapsed orientation to said expanded orientation;

the improvement wherein each of said planar elements has a pair of parallel cuts therethrough to define strip means, said strip means being secured to said planar element at both ends of said strip means, and said biasing means comprises a conically-shaped helical spring having a pair of opposed ends and at least one coil therebetween, each end of said spring passing through a respective one of said planar elements and engaging a respective strip means for movement therewith.

13. In a bag stuffer for an expandable bag, said bag stuffer comprising:

(A) insert means defining a pair of substantially planar elements movable from a collapsed orientation enabling compact storage of an expandable bag containing said insert means to an expanded orientation providing a commercial display of an expandable bag containing said insert means;

(B) biasing means for biasing said insert means to said expanded orientation; and (C) releasable restraining means, disposed about said insert means and adapted to be disposed at least partially within an expandable bag containing said insert means, for restraining movement of said insert means from said collapsed orientation to said expanded orientation;

the improvement wherein:

said insert means includes first, second and third substantially planar elements disposed in series parallel to one another, and said biasing means includes a first biasing element substantially disposed intermediate said first and second planar elements and acting to separate the same and a second biasing element substantially disposed intermediate said second and third planar elements and acting to separate the same;

each of said biasing elements is a coil spring having a pair of opposed ends and a plurality of coils therebetween, each end of said spring passing through a respective one of said planar elements with at least substantially one coil disposed outwardly of said respective planar element for movement therewith; and said restraining means is a loop of a flexible strip formed by heat sealing one end of said strip to a strip portion adjacent the other end of said strip at at least one point to define a rupturable heat-seal bond.

* * * * *